US006414439B1

(12) United States Patent
Tuenge et al.

(10) Patent No.: US 6,414,439 B1
(45) Date of Patent: Jul. 2, 2002

(54) AMEL DEVICE WITH IMPROVED OPTICAL PROPERTIES

(75) Inventors: Richard T. Tuenge, Hillsboro; Stephanier J. Moehnke, Forest Grove; Kumnith Ping, Beaverton; William Arno Vetanen, Dundee, all of OR (US)

(73) Assignee: Planar Systems, Inc., Beaverton, OR (US)

( * ) Notice: Subject to any disclaimer, the term of this patent is extended or adjusted under 35 U.S.C. 154(b) by 0 days.

(21) Appl. No.: 09/804,611

(22) Filed: Mar. 12, 2001

(51) Int. Cl.[7] ..... H01J 9/00

(52) U.S. Cl. ..... 315/169.1; 315/169.3; 313/506; 313/509

(58) Field of Search ..... 315/169.3, 169.1; 313/506, 509

(56) References Cited

U.S. PATENT DOCUMENTS

| | | | | |
|---|---|---|---|---|
| 5,463,279 A | | 10/1995 | Khormaei | |
| 5,598,059 A | | 1/1997 | Sun et al. | |
| 5,841,230 A | * | 11/1998 | Ikoma et al. | 313/506 |
| 5,986,628 A | | 11/1999 | Tuenge et al. | |

* cited by examiner

*Primary Examiner*—David Vu
(74) *Attorney, Agent, or Firm*—Chernoff, Vilhauer, McClung & Stenzel, LLP

(57) ABSTRACT

An alternating current thin-film electroluminescent device includes a plurality of pixel electrodes. An electroluminescent phosphor material is located between a first dielectric layer and a second dielectric layer. A transparent electrode layer, wherein at least a portion of the electroluminescent phosphor material and the first and second dielectric layers are located between the pixel electrodes and the transparent electrode layer. The first dielectric layer is closer to the transparent electrode layer than the second dielectric layer. The phosphor material is patterned.

23 Claims, 7 Drawing Sheets

AMEL DEVICE WITH IMPROVED OPTICAL PROPERTIES

BACKGROUND OF THE INVENTION

The present invention relates to a thin-film electroluminescent device providing improved optical properties.

In general, AMEL displays are constructed of a thin-film laminar stack comprising a transparent front electrode carrying an alternating current illumination signal, which is typically indium tin oxide deposited on a non-transparent silicon substrate. An electroluminescent phosphor layer is sandwiched between front and rear dielectric layers, all of which is deposited behind the front electrodes. Pixel electrodes are behind the rear dielectric layer, typically consisting of a pad of metal or poly-silicon, positioned at each location a pixel is desired within the phosphor layer. An insulator made of any suitable material, such as $SiO_2$ or glass, is on the pixel electrodes and the rear dielectric layer. The insulator layer is preferably constructed with holes in the insulator layer commonly referred to as VIA for each pixel electrode, to permit the connection of the pixel electrodes to a circuit layer which is deposited on a substrate layer, such as silicon. The circuit layer permits the individual addressing of each pixel electrode. As such, an individual pixel within the electroluminescent layer may be selectively illuminated by the circuit layer permitting a sufficient electrical field to be created between the front electrode and the respective pixel electrode. Normally the AMEL display is fabricated starting with the substrate. One example of an AMEL device is described by Khormaei, U.S. Pat. No. 5,463,279, incorporated by reference herein.

For many applications, such as computer graphics, video, and virtual reality, a multi-color display is desirable. There are several currently accepted techniques to obtain a color display. One such method is the use of spatially patterned filters superimposed over a "white" screen to provide the three primary colors, such as red, blue, and green. Each of the filters of a pixel provides a respective sub-pixel. An example of a thin-film electroluminescent screen of this type is disclosed by Sun et al., U.S. Pat. No. 5,598,059. However, as the pitch between adjacent pixels becomes increasingly small a greater percentage of the light directed toward and intended for a particular sub-pixel is directed through the filter material overlying an adjacent sub-pixel of a different color. The result is a degradation in the ability to produce accurate colors. A further refinement to increase the color purity includes patterning a substantially non-conductive light absorbing material over the front transparent electrode surrounding the color filters to decrease the light intended for a particular sub-pixel from actually passing through adjacent sub-pixels of a different color.

Tuenge, U.S. patent Ser. No. 08/856,140 discloses an approach to construct a color AMEL device that includes a field-sequential liquid crystal color shutter in series with a broad band white electroluminescent phosphor. The color shutter switches the colors displayed by each pixel using fast transition liquid crystal cells. Unfortunately, the liquid crystal cells absorb a substantial amount of light incident thereon thereby reducing the overall brightness of the display. In addition, the number of different colors that can be displayed during a particular frame is restricted to the switching time of the liquid crystal cells and the electroluminescent light source. Moreover, the liquid crystal cells increase the weight and thickness of the display. Also, the liquid crystal cells are temperature sensitive and reduce the operating temperature range of the device to less that it would have been without the liquid crystal cells.

DETAILED DESCRIPTION OF THE INVENTION

Figure 1:
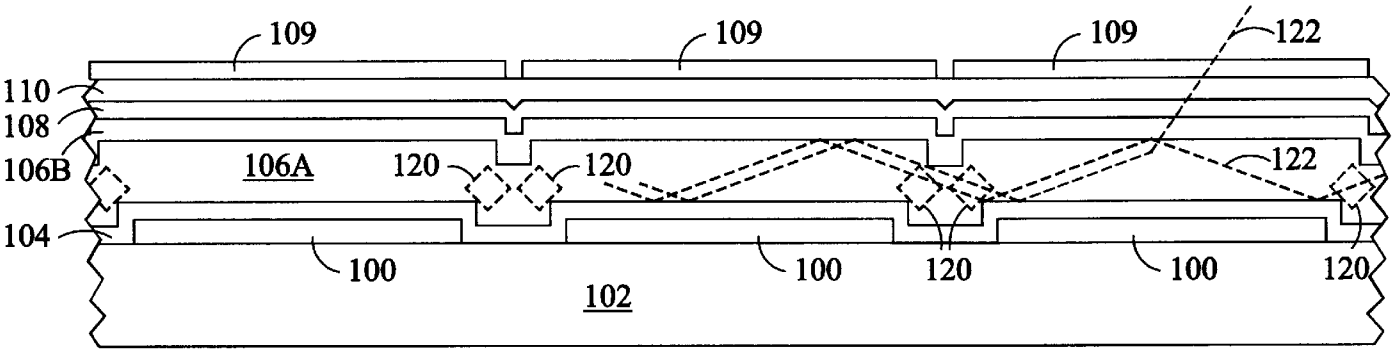
FIG. 1 is a sectional view of an AMEL display.

Referring to FIG. 1, normally the rear pixel electrodes 100 are constructed from titanium tungsten and are raised from the general overall upper surface of the rearwardly disposed silicon wafer substrate. On (or within) the silicon wafer 102 are control circuitry for individually or collectively addressing the pixel electrodes. Preferably the pixel electrodes are 0.3 microns thick and have a generally polygonal shape, such as a rectangle, an octagon, or a square. A rear dielectric layer 104, such as aluminum titanium oxide, is formed on the substrate 102 and the pixel electrodes 100.

Preferably the rear dielectric layer 104 is 0.2 microns thick. One or more thin-film phosphor layers 106*a* and 106*b* are deposited over the substrate 102, the pixel electrodes 100, and the rear dielectric layer 104. Preferably, the phosphor layer(s) produce light output suitable for a large gamut of the visible spectrum, such as red, blue, and green light emission. For example, a SrS:Ce phosphor layer (0.8 microns) may be used to provide blue/green light and a ZnS:Mn phosphor (0.4 microns ) may be used to produce a yellow light. The phosphors layers are constructed using any suitable process such as atomic layer epitaxy, sputtering, etc. In addition the phosphor layer(s) 106A,B may provide narrow band(s) of light output or wide band(s) depending on the particular application. Moreover, the phosphor layers may be patterned, if desired. A front dielectric layer 108, such as aluminum titanium oxide, is formed on the phosphor layer 106B. Preferably the front dielectric layer 108 is 0.2 microns thick. A front transparent electrode 110, such as indium tin oxide, is formed over the front dielectric layer 108, preferably 0.3 microns thick. Over the front transparent electrode 110 is located one or more color filters 109. The color filters may be of any design to selectively pass light of a particular color or wavelength range there through.

Figure 2:
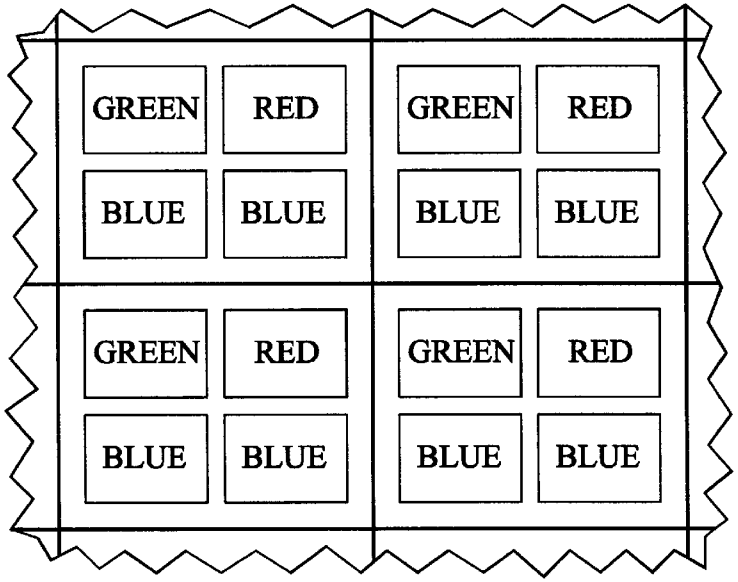
FIG. 2 is a partial top view of the AMEL display of FIG. 1.

Referring also to FIG. 2, the present inventors came to the realization that one of the major sources of light emission being directed from a region of the phosphor material proximate a pixel electrode corresponding to its sub-pixel in a direction toward another sub-pixel, such as an adjacent sub-pixel, comes from the phosphor material adjacent corner regions 120 of the pixel electrodes 100. The phosphor regions 120 proximate the corner regions of the pixel electrodes has a greater tendency to direct light in a substantially non-perpendicular direction to the pixel electrode thereby resulting in light exiting through a non-desired sub-pixel, as generally illustrated in FIG. 2. In addition, the phosphor regions proximate the corner regions of the pixel electrodes is relatively close to adjacent sub-pixels in comparison to the phosphor material proximate the central region of the pixel electrodes so the light, even if directed generally forward, has a greater tendency to exit an adjacent sub-pixel. Also, a portion of the light generated from the regions proximate the corner regions 120 of the pixel electrodes 100 having an angle with respect to the surfaces of the phosphor layer 106A less than the critical angle will tend to internally reflect within the phosphor material (as illustrated by light 122). Accordingly, the phosphor layer 106A has a tendency to guide light away from the pixel electrode and some of this guided light will exit through another unintended sub-pixel if the light's angle increases past the critical angle of the phosphor 106A—front dielectric layer 108 interface.

Figure 3:
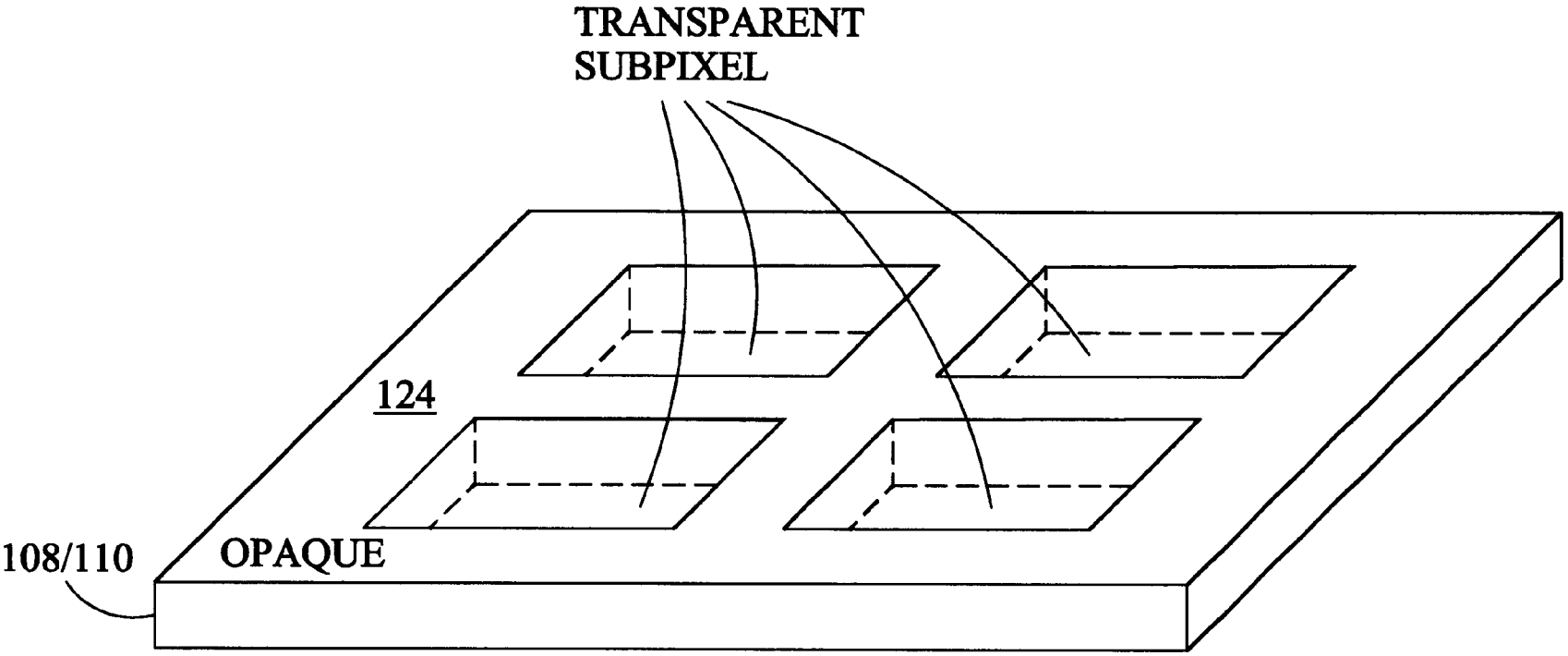
FIG. 3 is a pictorial view of an exemplary embodiment of an AMEL display constructed in accordance with the present invention.

Referring to FIG. 3, one potential solution to reduce the light guiding of the phosphor layer(s) is to pattern the front dielectric layer 108 or front transparent electrode 110 with light absorbing material 124 therein in regions generally between adjacent sub-pixels and/or pixels. The light absorbing material 124 will block the transmission of light in undesirable locations. While a potential solution, the patterning of the front dielectric layer 108 requires difficult processing techniques.

Figure 4:
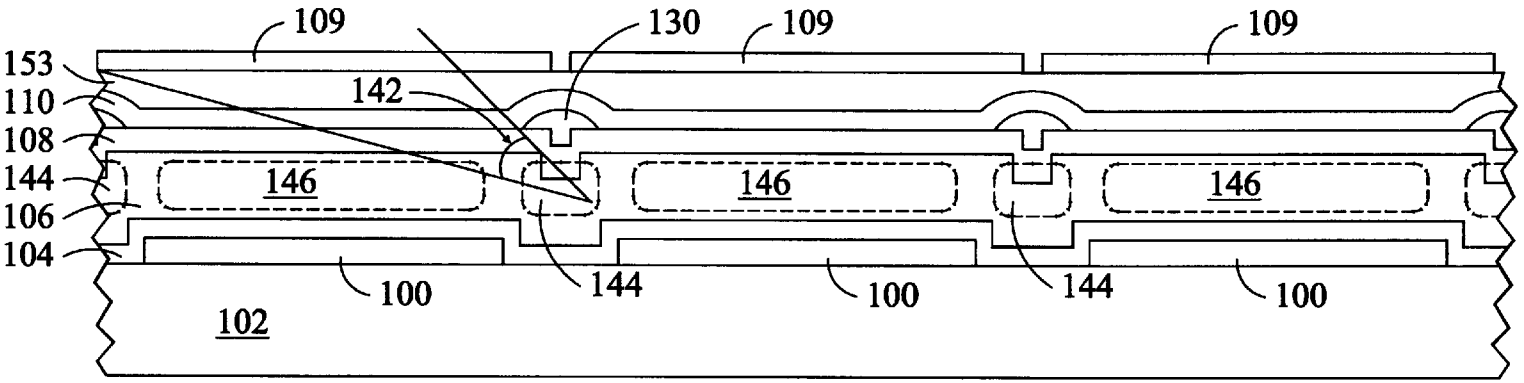
FIG. 4 is a sectional view of another embodiment of an AMEL display constructed in accordance with the present invention.

Referring to FIG. 4, the present inventors came to the realization that it is preferable to control the regions within the phosphor material 106 upon which a sufficient voltage is imposed to generate light. In order to provide control over the voltages within the phosphor material 106 the present inventors further came to the realization that the inclusion of an additional patterned layer of light absorbing and/or blocking material (opaque) 130, such as dyed photo-resist, in a region between the front dielectric layer 108 and the front electrode layer 110 is useful. It is to be noted that additional layers may be included between the front dielectric layer 108 and the front electrode layer 110. The light absorbing material 130 in the embodiment shown in FIG. 4 is not overlapping with the pixel electrodes 100. An additional smoothing layer 153 may be included under the filters 109.

One of the effects of including a light absorbing material 130 at a location under the front electrode layer 110 is to position the light absorbing material 130 closer to the phosphor material 106 (shown as a single phosphor layer) thereby reducing the angular range 142 of light from one pixel electrode region that can pass to adjacent sub-pixels, as illustrated in FIG. 4. This improves the potential color purity of the display.

In addition, the light absorbing material significantly increases the distance between the pixel electrode 100 and the front electrode 110 in a region generally under the light absorbing material 130 which decreases the magnitude of the electric field in the phosphor material 144 generally under the light absorbing material 130 relative to the magnitude of the electric field in the phosphor material 146 directly over the pixel electrode. The reduction in the magnitude of the electric field in the phosphor material 144 generally under the light absorbing material 130 is sufficient to reduce the imposed voltage to less than the threshold voltage for light emission of the phosphor material 144. The reduction, and preferably the near elimination of light emission in the phosphor material 144 generally under the light absorbing material 130 decreases the generation of light closer adjacent sub-pixels which in turn decreases the amount of light that is misdirected to adjacent sub-pixels.

In addition, the present inventors observed that many AMEL devices include a ground plane therein, such as those described in U.S. Pat. No. 5,463,279, between the substrate and the pixel electrodes. An electric field is generated between the ground plane and the pixel electrodes. Since all, or at least a portion of, the ground plane is disposed under the pixel electrode, the ground plane electrically couples to the pixel electrodes. Since the coupled ground plane extends under other pixel electrodes the ground plane will, in turn, electrically couple to the rear dielectric layer 104 at locations between the pixel electrodes. The rear dielectric layer 104, having a significant voltage imposed thereon by the electrical coupling effect, may be sufficient to cause intermediate light generation in regions between pixel electrodes. In effect, the coupled regions of the rear dielectric layer 104 acts as additional pixel electrodes potentially setting up sufficient electrical fields to produce light in the phosphor material between the pixel electrodes and in regions proximate other pixel electrodes. The light absorbing material 130 displaces the front electrode layer 110 further away from the rear dielectric layer 104 at locations generally between the pixel electrodes which decreases the electrical field imposed in portions of the phosphor layer. This likewise reduces the light generation within the phosphor material at locations intermediate to the pixel electrodes which in turn increases the color purity.

Accordingly, locating the light absorbing material between the front electrode layer and the phosphor layer serves both the purpose of blocking the transmission of light and also controls the generation of light itself from within the phosphor material itself by changing the electric field (voltage) otherwise imposed therein.

Figure 5:
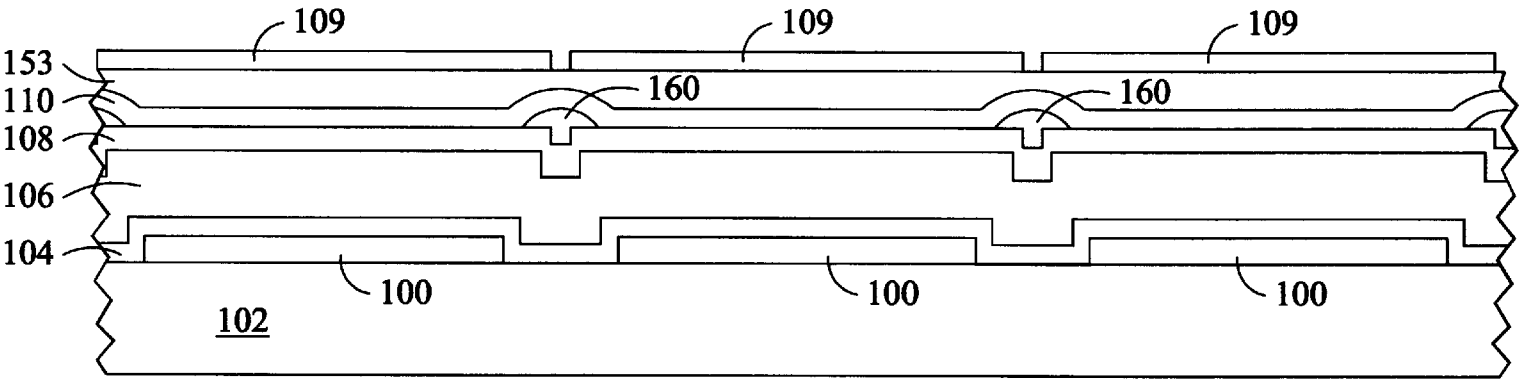
FIG. 5 is a sectional view of yet another embodiment of an AMEL display constructed in accordance with the present invention.

Referring to FIG. 5, the present inventors came to the realization that a further improvement in color purity may be realized by patterning the light absorbing material 160 so as to overlap at least a portion of the pixel electrodes 100. The overlapping light absorbing material 160 reduces the electrical field between the portions of the pixel electrode proximate the corners thereof and the corresponding front electrode layer 110. The reduced electrical field within the phosphor material proximate the corners of the pixel electrodes 110 likewise decreases the amount of light which is misdirected toward adjacent sub-pixels, as previously described. Accordingly, the light absorbing material reduces the effective fill factor of the AMEL device while retaining larger pixel electrodes which are easier to fabricate.

Another embodiment of the present invention includes the replacement of the light absorbing material, either in an overlapping or non-overlapping fashion, with a substantially non-light absorbing material (e.g., transparent material). While not providing the light absorbing functionality, the non-light absorbing material still displaces the transparent electrode layer which reduces, or otherwise eliminates, the voltage imposed in a portion of the phosphor material, as previously discussed. The non-light absorbing material is preferably primarily non-conductive. This improves the color purity of the display.

Another potential source of undesirable light degrading color purity of the display is the piping of light within the phosphor material from a region proximate a first pixel to a region proximate another pixel, such as an adjacent pixel. One potential solution is to pattern the phosphor material itself as a single layer. In general the resulting single phosphor layer is achieved by creating a first layer of phosphor material. Then unwanted regions of the first layer of material are masked and etched away. Thereafter, a second layer of phosphor material is deposited in the etched regions away, with any excess of the second phosphor layer being etched away. This process is repeated for each different phosphor material employed. However merely etching different phosphor layers in a manner to achieve a single layer of different phosphor materials arranged in a matrix, each portion of which is associated with a different pixel, results in significant process complexity. Further, the threshold voltages for effective light illumination from the phosphor materials may vary for each different phosphor material, resulting in uneven light output from the display.

Figure 6:
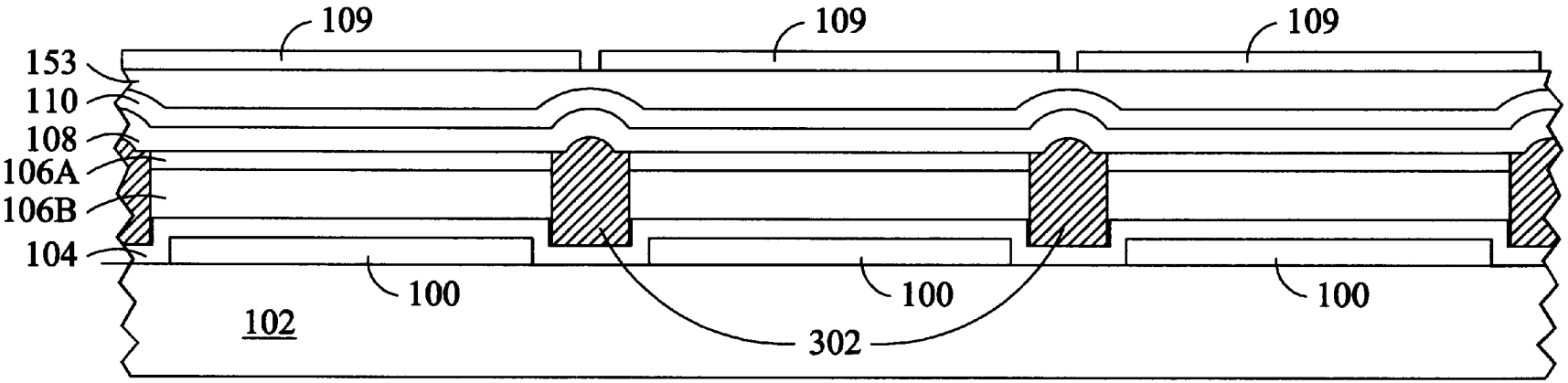
FIG. 6 is a sectional view of yet another embodiment of an AMEL display constructed in accordance with the present invention.
Figure 7:
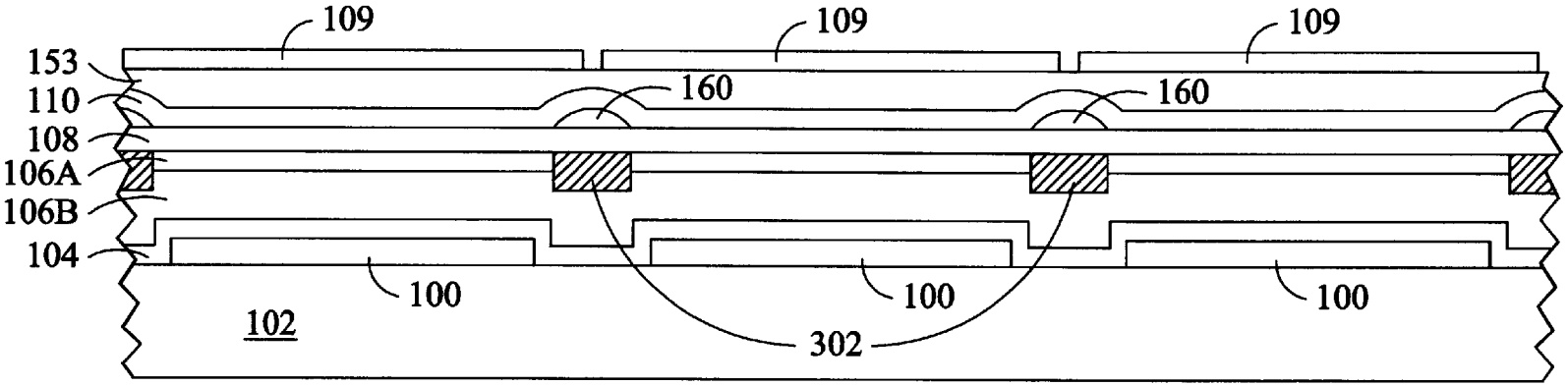
FIG. 7 is a sectional view of yet another embodiment of an AMEL display constructed in accordance with the present invention.
Figure 8:
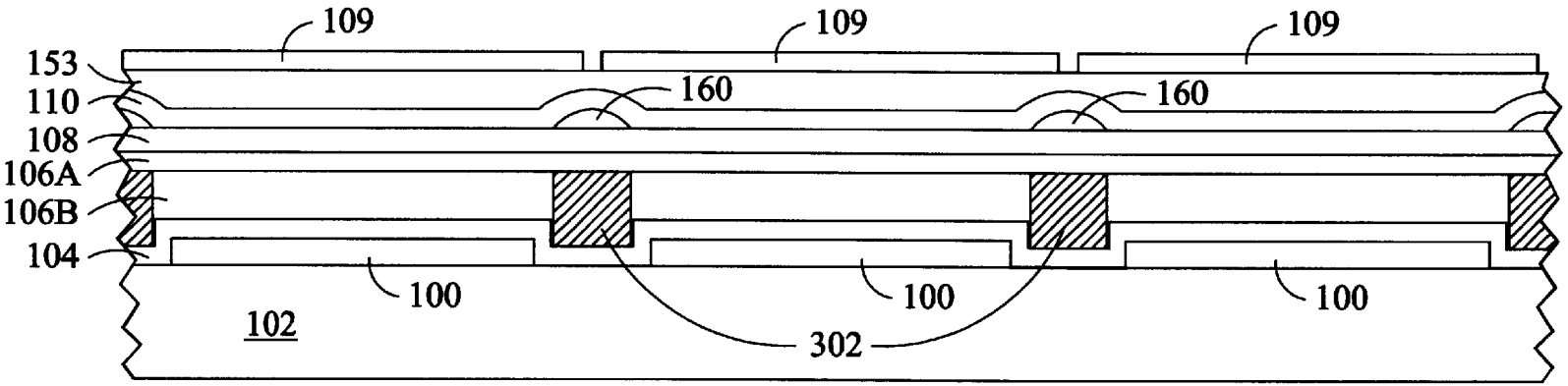
FIG. 8 is a sectional view of yet another embodiment of an AMEL display constructed in accordance with the present invention.

Referring to FIG. 6, in order to overcome the processing complexity and threshold variations of a single phosphor layer, the present inventors determined that a multi-phosphor layer phosphor stack should be etched or otherwise patterned to provide individual regions of phosphor material associated with one or more pixels. The phosphor material may be non-overlapping or overlapping with the pixel electrodes. This results in a multi-layered phosphor stack associated with each pixel where the light piping between pixels is inhibited by the etched regions between the pixels. The etched regions are preferably filled with an opaque material 302, a light absorbing material, or otherwise a material that inhibits the passage of light within the phosphor material. The resulting structure has relatively uniform threshold voltage so that the resulting luminance of the display may be uniform. It is to be understood that any suitable number of phosphor layers may be used, as desired. Referring to FIGS. 7 and 8, less than all of the phosphor layers may be patterned, as desired. Moreover, the removal of merely a portion of a phosphor likewise results in an improvement of the color purity. Accordingly, merely a depression in the phosphor material may be necessary.

Figure 9:
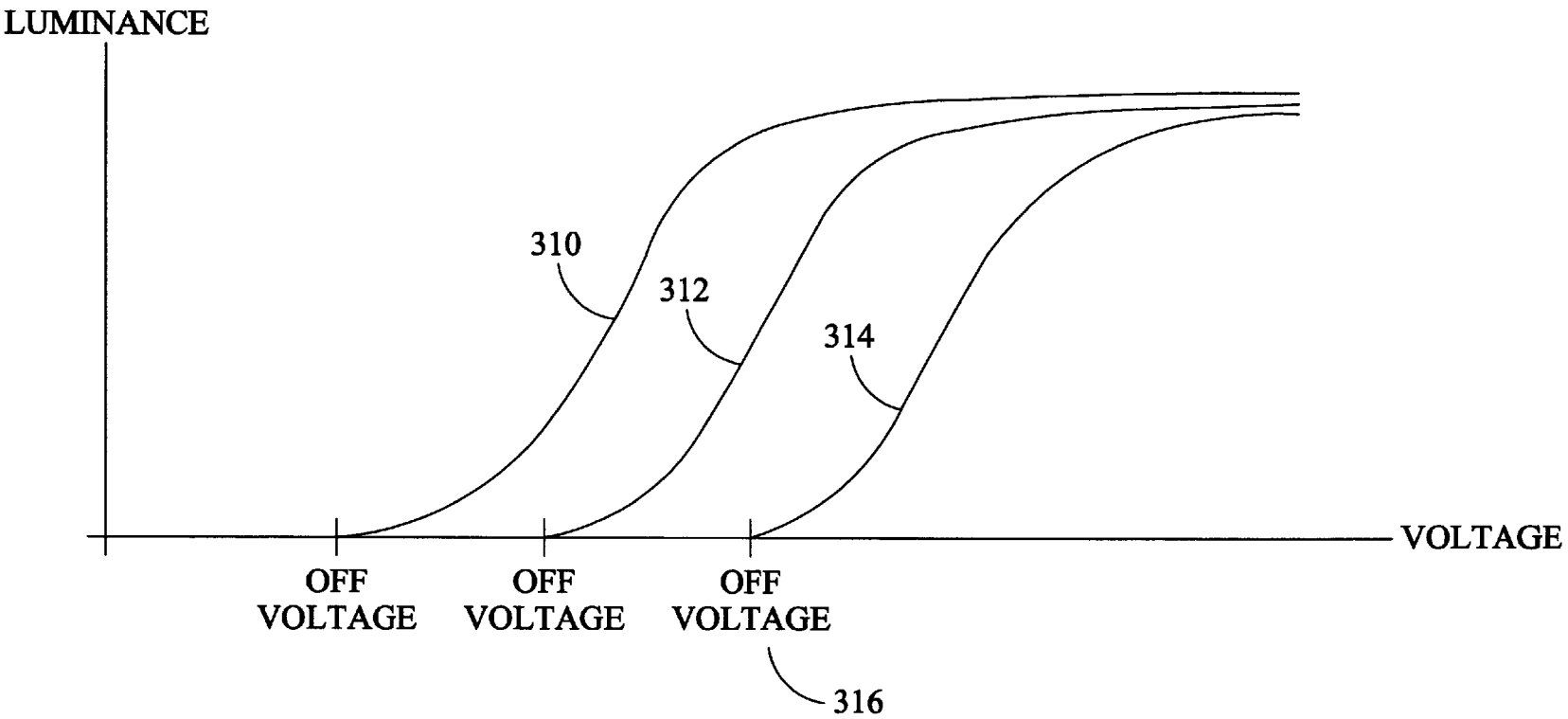
FIG. 9 is a representation of the luminance versus voltage curves for three different phosphor materials.
Figure 10:
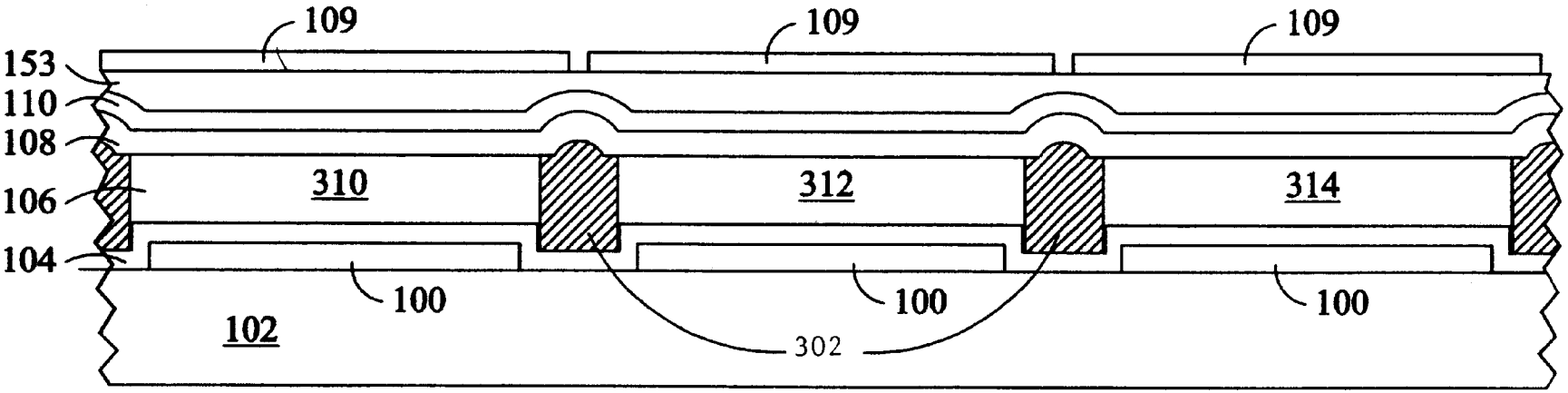
FIG. 10 is a sectional view of yet another embodiment of an AMEL display constructed in accordance with the present invention.

After consideration of the desire to fabricate a device including a single layer of patterned phosphor materials the present inventors considered the variable threshold voltages of the phosphor materials. The single layer may be characterized by the phosphor material including a plurality of different phosphor materials, wherein each of the phosphor materials is free from substantial stacking upon one another. Referring to FIGS. 9 and 10, a representation of the luminance versus voltage curves for three different phosphor materials 310, 312, and 314 is illustrated. Any number of different phosphor materials may be used and color filters may be used, as desired. Typically the construction and operation of the AMEL device results in applying a positive voltage to the pixel electrodes to maintain the corresponding pixel being in an "off" state. Conversely, grounding or otherwise lowering the voltage on the pixel electrodes permits the corresponding pixels to be illuminated (e.g., "on" state). To maintain the desired voltage on the pixel electrodes normally a transistor, such as a D-MOS transistor, is employed. Each of the phosphors has a different corresponding off voltage. Therefore, one particular design of the corresponding transistor structure may be performed by using two or more different voltage thresholds applied to the pixel electrodes, such as by using different voltages applied to the D-MOS transistors. A more preferred design includes the voltage applies to the pixel electrodes being the same, with the selected voltage being based upon the greatest threshold voltage 316 of the phosphor material.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An alternating current thin-film electroluminescent device comprising:

(a) a plurality of pixel electrodes;

(b) an electroluminescent phosphor material located between a first dielectric layer and a second dielectric layer;

(c) a transparent electrode layer wherein at least a portion of said electroluminescent phosphor material and said first and second dielectric layers are located between said pixel electrodes and said transparent electrode layer, where said first dielectric layer is closer to said transparent electrode layer than said second dielectric layer; and (d) said phosphor material being patterned in such a manner as to inhibit the passage of light within at least a portion of said phosphor material.

2. The device of claim 1 wherein said phosphor material provides a broad white output.

3. The device of claim 1 wherein said phosphor material includes multiple layers of different phosphor materials.

4. The device of claim 1 wherein said phosphor material is patterned substantially around a pixel electrode.

5. The device of claim 4 wherein said pixel electrode includes a respective plurality of sub-pixels.

6. The device of claim 5 wherein at least two of said sub-pixels have a different output spectrum.

7. The device of claim 6 wherein said phosphor material is patterned substantially around each said sub-pixel.

8. The device of claim 7 wherein said patterned portion of said phosphor material is non-overlapping with said pixel electrodes.

9. The device of claim 7 wherein said phosphor material is overlapping with said pixel electrodes.

10. The device of claim 1 wherein said phosphor material includes patterned etches passing through said phosphor material.

11. The device of claim 10 wherein said etches define regions corresponding with said pixel electrodes.

12. The device of claim 11 wherein each of said regions corresponding with a single pixel electrode.

13. The device of claim 1 wherein said phosphor material includes multiple layers of different phosphor materials and said pattern is depressed through at least a portion of said multiple layers.

14. The device of claim 13 wherein said depression passes through at least one of said layers.

15. The device of claim 13 wherein said depression passes through said multiple layers.

16. The device of claim 14 wherein said depression is created by etching said phosphor material.

17. The device of claim 13 wherein said depression is filled with filling material that inhibits the passage of light therethrough.

18. The device of claim 14 wherein said depression is filled with filling material that inhibits the passage of light therethrough.

19. The device of claim 15 wherein said depression is filled with filling material that inhibits the passage of light therethrough.

20. The device of claim 1 wherein said phosphor material includes a plurality of different phosphor materials, wherein each of said phosphor materials is free from substantial stacking upon one another.

21. The device of claim 20 wherein the "off voltage" applied to said pixel electrodes is selected based upon the threshold voltage of the corresponding phosphor material.

22. The device of claim 21 wherein the same said "off voltage" is applied to a plurality of said pixel electrodes, at least two of which correspond to different phosphor materials.

23. The device of claim 22 wherein said "off voltage" corresponds to the greatest threshold voltage of said phosphor material.

* * * * *

UNITED STATES PATENT AND TRADEMARK OFFICE

CERTIFICATE OF CORRECTION

PATENT NO. : 6,414,439 B1
DATED : July 2, 2002
INVENTOR(S) : Tuenge, et al.

It is certified that error appears in the above-identified patent and that said Letters Patent is hereby corrected as shown below:

Column 2,
Lines 42 and 43, delete the new paragraph spacing between "electrodes 100." and "Preferably the rear".

Signed and Sealed this

Twenty-seventh Day of December, 2005

JON W. DUDAS
*Director of the United States Patent and Trademark Office*